US008406649B2

(12) United States Patent
Cavill et al.

(10) Patent No.: US 8,406,649 B2
(45) Date of Patent: Mar. 26, 2013

(54) APPARATUS FOR PROVIDING ELECTRICAL CONTACT BETWEEN A POWER SUPPLY AND A PHOTOCONDUCTIVE DRUM IN AN IMAGE FORMING DEVICE

(75) Inventors: Gregory Alan Cavill, Winchester, KY (US); Gary Neal Hackney, Georgetown, KY (US); Benjamin Keith Newman, Lexington, KY (US); Keith Seaman, Lexington, KY (US); Christopher Gene Vowels, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 571 days.

(21) Appl. No.: 12/580,614

(22) Filed: Oct. 16, 2009

(65) Prior Publication Data

US 2010/0290802 A1 Nov. 18, 2010

Related U.S. Application Data

(60) Provisional application No. 61/177,441, filed on May 12, 2009.

(51) Int. Cl.
*G03G 15/00* (2006.01)

(52) U.S. Cl. ..... 399/90; 399/116

(58) Field of Classification Search ..... 399/115–117, 399/168, 90, 174, 111
See application file for complete search history.

(56) References Cited

U.S. PATENT DOCUMENTS

| | | | | |
|---|---|---|---|---|
| 5,210,574 | A * | 5/1993 | Kita | 399/117 |
| 6,249,659 | B1 * | 6/2001 | Stickler | 399/90 |
| 6,336,012 | B1 * | 1/2002 | Noda et al. | 399/90 |
| 7,050,736 | B2 * | 5/2006 | Hale et al. | 399/90 |

* cited by examiner

*Primary Examiner* — Walter L Lindsay, Jr.
*Assistant Examiner* — Jessica L Eley

(57) ABSTRACT

In an image forming device an apparatus is provided that supplies a continuous flow of an electrical charge between a photoconductive drum and a power supply. In one embodiment, an electrically conductive member receives a shaft of the photoconductive drum. An electrically conductive cap disposed on a first side of the electrically conductive member, aligned with an aperture of the electrically conductive member, and capable of being electrically coupled with the shaft via the electrically conductive member. There is also an electrically conductive resilient member having a leading end and a trailing end electrically couple with the electrically conductive member and the shaft in a manner that the leading end is disposed on the first side of the electrically conductive member and the trailing end is disposed on the second side of the electrically conductive member with at least a portion of the trailing end extending across the aperture of the electrically conductive member.

26 Claims, 6 Drawing Sheets

APPARATUS FOR PROVIDING ELECTRICAL CONTACT BETWEEN A POWER SUPPLY AND A PHOTOCONDUCTIVE DRUM IN AN IMAGE FORMING DEVICE

CROSS REFERENCES TO RELATED APPLICATIONS

This patent application is related to and claims benefit from U.S. patent application Ser. No. 61/177,441 filed May 12, 2009, entitled "Printing Device" and assigned to the assignee of the present application, the contents of which is hereby incorporated by reference in its entirety.

BACKGROUND

1. Field of the Invention

The present invention relates to image forming devices, and more particularly to those image forming devices having a redundant electrical contact between a power supply and a photoconductive drum.

2. Description of the Related Art

Image forming devices include copiers, laser printers, facsimile machines, and the like. Image forming devices may have a photoconductive drum having a photoconductive surface that is typically charged to a uniform electrical potential. The photoconductive surface is selectively exposed to light in a pattern corresponding to an original image. As a result of this selective exposure, certain areas of the photoconductive surface are discharged resulting in formation of a latent electrostatic image thereon.

A developer material, such as toner, having an opposite electrical charge relative to the photoconductive drum, when brought into contact with or otherwise near the photoconductive surface becomes attracted to the photoconductive surface due to the charge placed thereon. Further, a recording medium, such as a blank sheet of paper or an intermediate transfer belt, is then brought into physical contact with the photoconductive surface. This physical contact allows the developer material to be transferred to the recording medium in the form of the latent electrostatic image when subjected to an electric field. Once the developer material is transferred to the sheet of paper, the sheet is then heated thereby permanently fusing the toner thereto.

As illustrated in FIG. 1, image forming devices typically include a printer supply contact 10 that is coupled to a power supply. The printer supply contact 10 is electrically coupled to a bearing 12 which in turn is electrically connected to an end of a shaft 14. The shaft 14 is received within the photoconductive drum 18 and electrically coupled thereto via a photoconductive drum contact 16. As a result of this electrical connectivity, photoconductive drum 18 may be charged to the desired level to support image transfer.

Thus, electrical connectivity of the bearing 12 with respect to the shaft 14 and the power supply contact 10 serves to ensure substantially uninterrupted flow of electric charge between the printer supply contact 10 and the shaft 14. Moreover, as the bearing 12 physically supports the shaft 14 and also a substantial load of a printer cartridge, bearing 12 should provide enough rigidity and strength to support the printer cartridge.

However, these characteristics have not always been sufficiently shown with conventional conductive bearings. This is because some conductive bearings are made from materials such as sintered bronze or conductive plastic, which are seen to have disadvantages.

One disadvantage of sinter bronze bearings is that such bearings contain oil that may be expelled when higher temperatures are experienced during prolonged imaging operations. This expelled oil collects debris, such as toner or paper dust, from the image forming device and coats the shaft of the photoconductive drum. This debris coating causes the electrical contact between the shaft and the bearing to fail, thereby preventing the photoconductive drum to be suitably charged. Another disadvantage is that the conductive plastic bearings may have a non-conductive outer layer that have been seen to interrupt the flow of electric charge between the bearing and the shaft.

Thus, given the above drawbacks of the conventional systems for charging photoconductive drums, there is a need for a charging system which provides substantially continuously supply of electric charge to the photoconductive drum of an image forming device.

SUMMARY OF THE INVENTION

Embodiments of the present invention overcome shortcomings seen in known charging systems for imaging devices and thereby satisfy a significant need for a charge system for substantially continuously providing charge to a photoconductor drum of an imaging forming device. According to an exemplary embodiment of the present invention, there is shown a charging system including an electrically conductive member having a first side and a second side and an aperture having an opening on the second side to receive a shaft of the photoconductive drum; an electrically conductive cap disposed on the first side of the electrically conductive member, aligned with the aperture and electrically coupled with the photoconductor drum shaft via the electrically conductive member; and an electrically conductive resilient member having a leading end and a trailing end. The leading end of the resilient member may be disposed on the first side of the electrically conductive member and electrically coupled with an inner surface of the electrically conductive cap. The trailing end of the resilient member may be disposed on the second side of the electrically conductive member such that at least a portion of the trailing end extending across the aperture of the electrically conductive member. A first electrical path is thereby formed between the conductive cap, the bearing and the photoconductor drum shaft, and a second electrical path is formed between the cap, the resilient member and the photoconductor drum shaft. Having two separate electrical paths from the cap to the photoconductor drum shaft ensures the photoconductor drum of the image forming device is substantially continuously charged during a printing operation.

BRIEF DESCRIPTION OF THE DRAWINGS

The above-mentioned and other features and advantages of the various embodiments of the invention, and the manner of attaining them, will be better understood by reference to the accompanying drawings, wherein.

DETAILED DESCRIPTION

Figure 1:
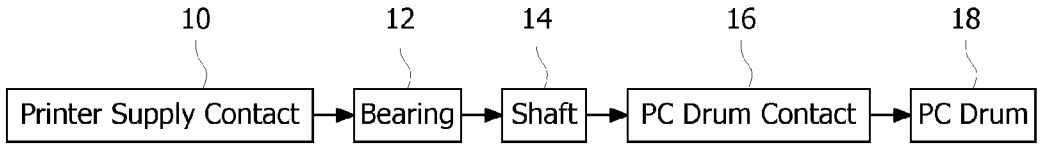
FIG. 1 (PRIOR ART)
FIG. 1 is block diagram of a charging system for a photoconductive drum of a conventional image forming device.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference will now be made in detail to the exemplary embodiment(s) of the invention, as illustrated in the accompanying drawings. Whenever possible, the same reference numerals will be used throughout the drawings to refer to the same or like parts.

Figure 2:
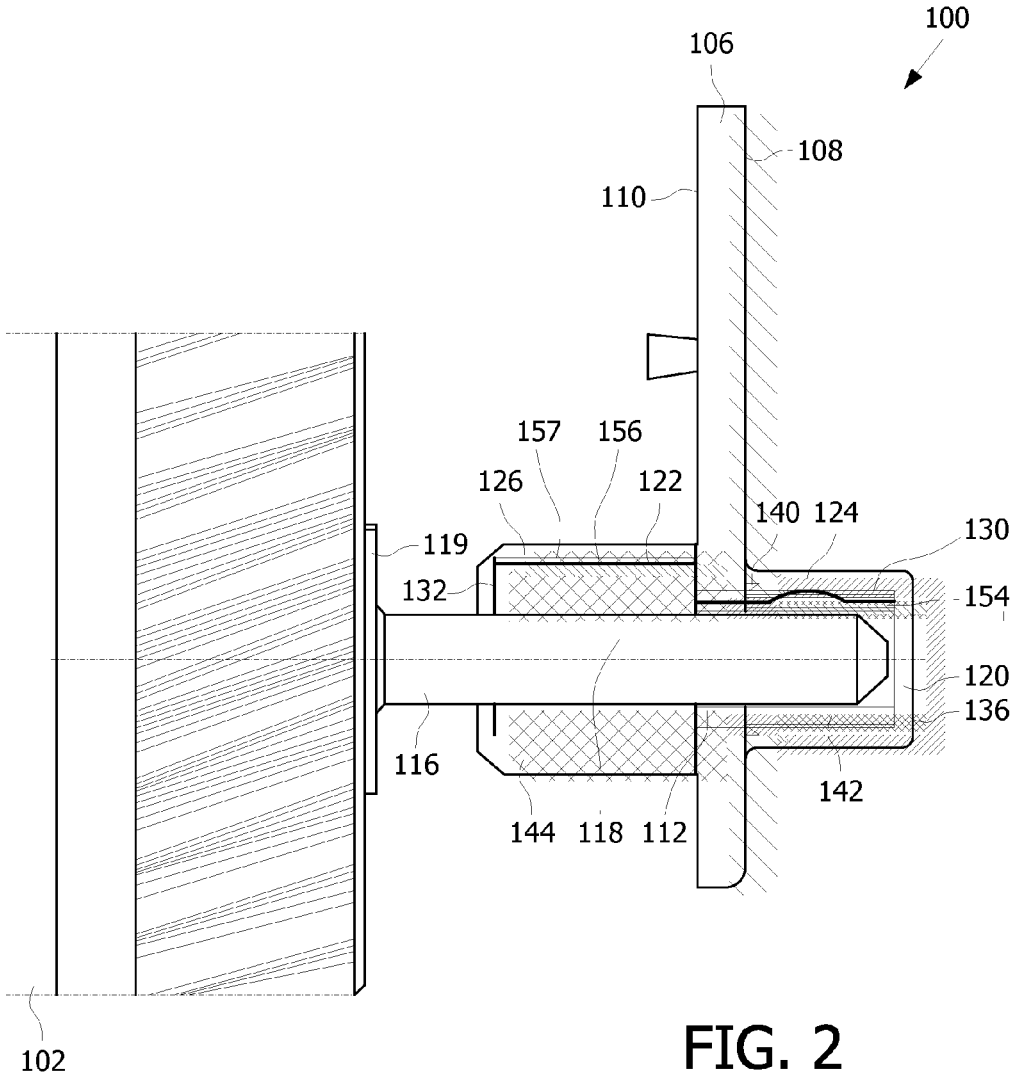
FIG. 2 is a cross-sectional side view of one embodiment of a charging apparatus for a photoconductive drum according to an exemplary embodiment of the present invention.

Referring to FIGS. 2-7, there is shown a charging apparatus 100 according to an exemplary embodiment of the present invention. The apparatus 100 provides an electrical connection between a power supply (not shown) and a photoconductive drum 102 within image forming device 104 so that photoconductive drum 102 may be charged to a desired level during a printing operation. The apparatus 100 includes an electrically conductive member, illustrated as a bearing 106, having a first side 108, a second side 110, and an aperture 112 defined between first side 108 and second side 110. The first side 108 of the bearing 106 is disposed nearer to the power supply, whereas the second side 110 of the bearing 106 is disposed proximal to the photoconductive drum 102. As shown in FIG. 2, the aperture 112 has a dimension that extends from the first side 108 of the bearing to the second side 110 of the bearing 106.

Aperture 112 of bearing 106 is dimensioned to receive end portion 118 of photoconductive drum shaft 116. End portion 118 of the photoconductive drum shaft 116 extends beyond bearing 106 so that drum shaft 116 is securely positioned within the bearing 106. Further, the photoconductive drum shaft 116 is arranged within the bearing 106 in a clearance fit arrangement so as to allow for photoconductive drum shaft 116 to securely rotate relative to a stationary bearing 106.

Bearing 106 of charging apparatus 100 may further include a first tubular member 142 and a second tubular member 144. The first and the second tubular members 142, 144 are disposed on and extend outwardly from the first and the second sides 108, 110 of the bearing 106, respectively. Further, the first tubular member 142 has a length that extends between the aperture 112 of bearing 106 and a first cantilever end 150 of first tubular member 142. The second tubular member 144 also has a length that extends between aperture 112 of bearing 106 and a second cantilever end 151 of second tubular member 144. Each of first and second tubular members 142, 144 is substantially cylindrically shaped and substantially hollow, thereby defining a passage extending the length of each tubular member. Furthermore, as can be seen from FIG. 2, the passage defined in first and the second tubular members 142, 144 are aligned with each other and with the aperture 112, thereby defining an elongated passage or channel for receiving photoconductor drum shaft 116 therein. With an elongated passage for receiving photoconductor shaft 116, bearing 106 provides sufficient rigidity and strength to support the photoconductive drum 102 when received within the image forming device 104.

As shown in FIGS. 2, 4, 5, and 6, a first longitudinal groove 154 is defined along an outer surface of first tubular member 142 and a second longitudinal groove 156 is defined along an outer surface 157 of second tubular member 144 of the bearing 106. Longitudinal axes of grooves 154, 156 may be substantially parallel to each other. A slot 158 is defined through a central portion of bearing 106 proximal to and substantially collinearly defined with first longitudinal groove 154. Longitudinal grooves 154, 156 serve to receive a portion of wire 122, as explained further hereinbelow.

The bearing 106 may be constructed from a plastic material that has conductive properties. Due to the conductive properties, bearing 106 is electrically coupled to components of charging apparatus 100 that are in physical contact therewith. Thus, as the bearing 106 is in physical contact with end portion 118 of the photoconductive drum shaft 116, an electrical connection is established between the bearing 106 and the photoconductive drum shaft 116. Alternatively, it is understood that bearing 106 may be constructed from other conductive materials.

Figure 3:
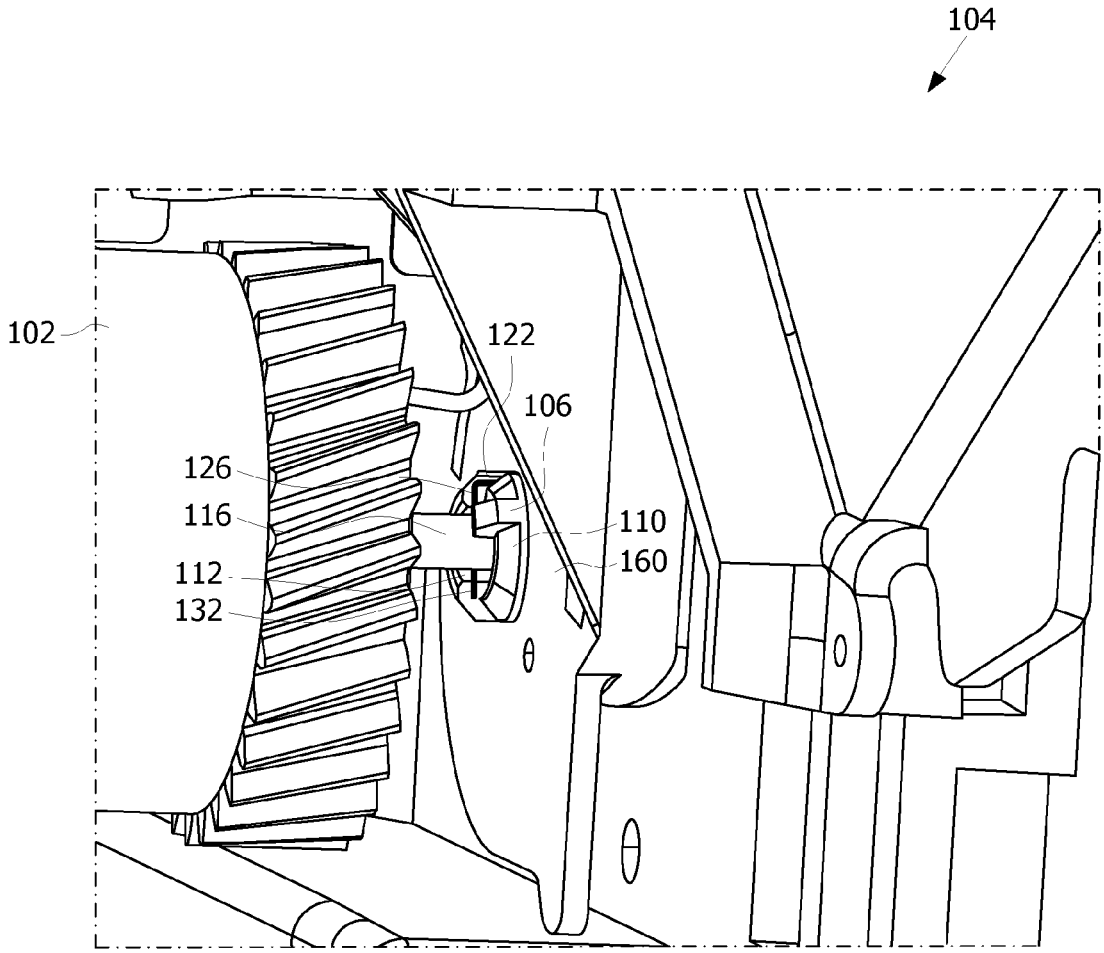
FIG. 3 is a left perspective view of the apparatus of FIG. 2.

The photoconductive drum shaft 116 is received within the photoconductive drum 102 as shown in FIGS. 2 and 3. Photoconductive drum 102 is electrically connected to the photoconductive drum shaft 116 via a photoconductive drum contact 119.

Charging apparatus 100 may further include an electrically conductive cap 120 which may be physically disposed about and attached to first tubular member 142 of bearing 106. The cap 120 may be also operatively connected to the power source so as to receive a continuous supply of electric charge therefrom.

Figure 4:
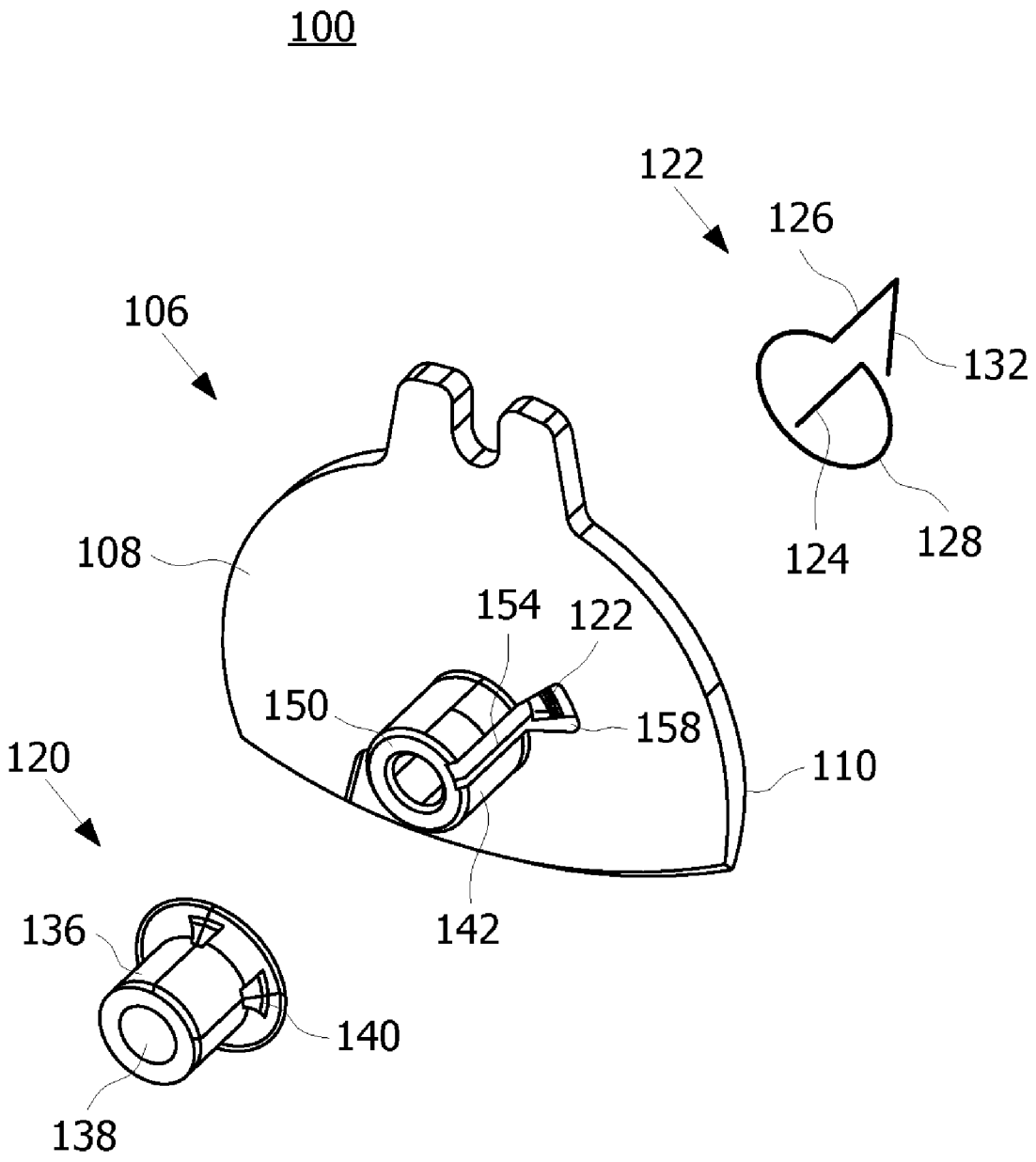
FIG. 4 illustrates a first exploded view of the apparatus of FIG. 2.
Figure 5:
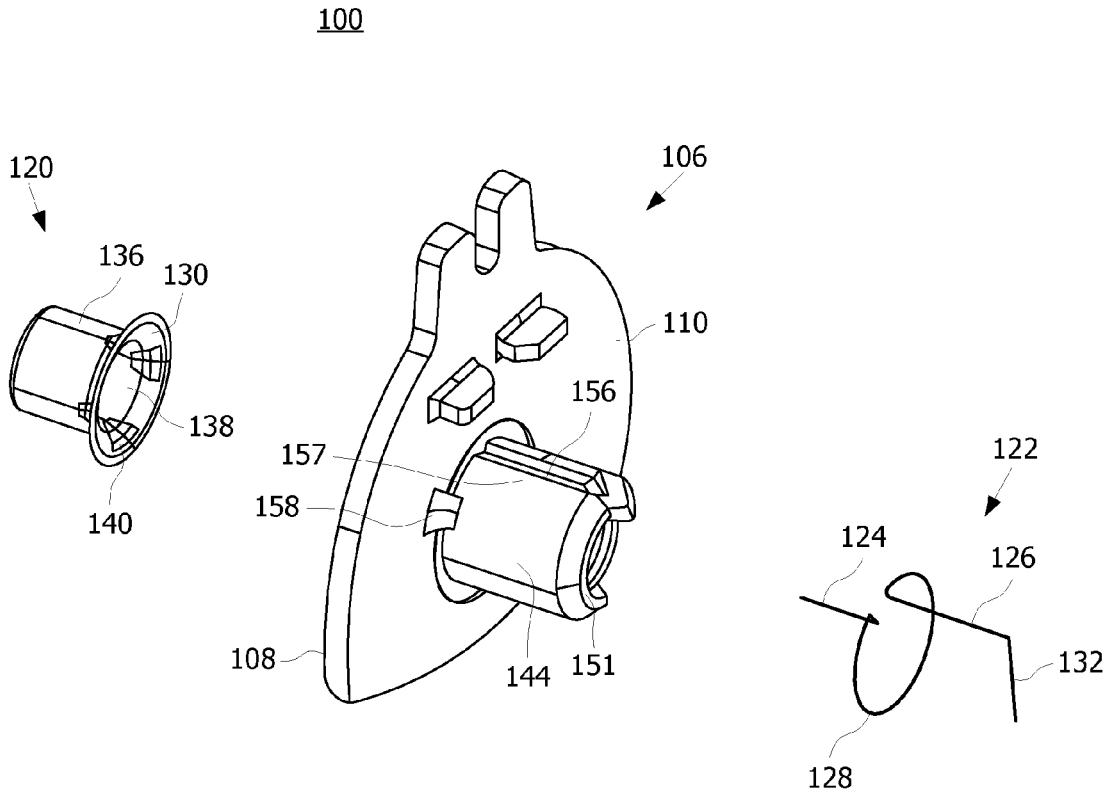
FIG. 5 illustrates a second exploded view of the apparatus of FIG. 2.
Figure 6:
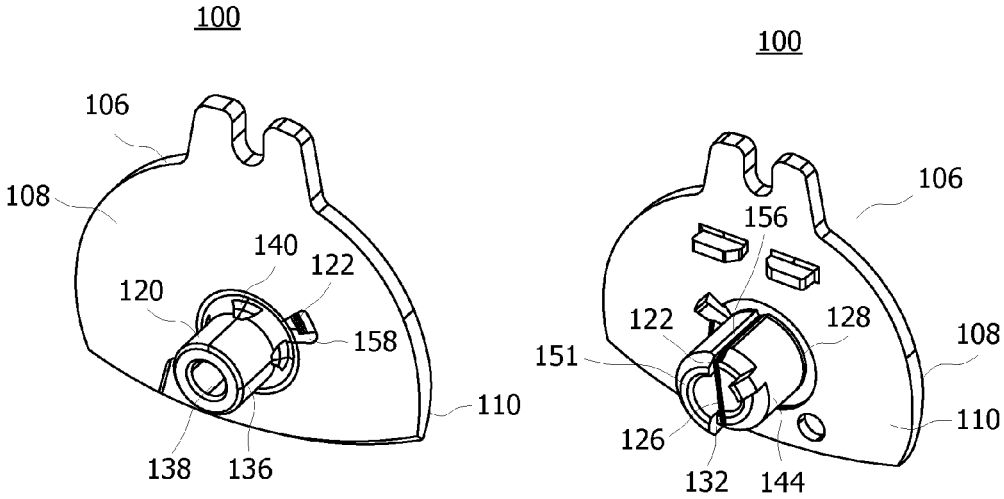
FIG. 6 shows assembled, perspective views of the charging apparatus of FIG. 2.

As illustrated from FIGS. 2, 4, 5 and 6, the cap 120 may include an inner surface 138 and an outer surface 136. Cap 120 may further include an annular member 130 which extends radially outwardly from cap 120 at an end portion thereof. Inner surface 138 of cap 120 is dimensioned for receiving first tubular member 142 of bearing 106, as shown in FIGS. 2, 4 and 6. When the cap 120 is disposed on the first side 108 of the bearing 106 over first tubular member 142, cap 120 is electrically connected to bearing 106 due to contact with first tubular member 142 as well as with side 108 of bearing 106 via annual member 130. Further, cap 120 substantially covers those portions of end portion 118 of the photoconductive drum shaft 116 that extends beyond the first side 108 of the bearing 106.

Figure 7:
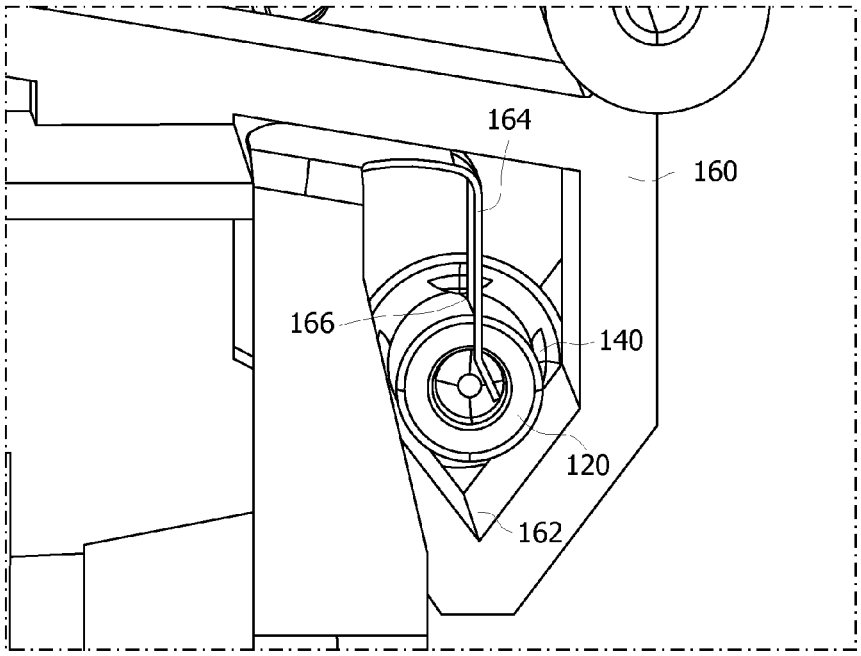
FIG. 7 shows a side view of apparatus of FIG. 2 within an image forming device according to an exemplary embodiment of the present invention.

Outer surface 136 of the cap 120 is electrically coupled with the power supply via a power supply contact 164 (best seen in FIG. 7). As shown in FIGS. 4 and 5, the cap 120 may include a plurality of extension tabs 140 which extend from cap 120, such as from annular member 130, into the passage defined by inner surface 138. Extension tabs 140 sufficiently extend into the passage of cap 120 so as to contact bearing 106 when secured onto first tubular member 142. For example, extension tabs 140 may contact first tubular member 142 and pierce an outer, non-conductive layer which may be disposed on bearing 106, when cap 120 is press fit onto bearing 106. By piercing through the outer, non-conductive layer of bearing 106, extension tabs 140 thereby create an electrically conductive path between cap 120 and bearing 106 and serves to more robustly ensure uninterrupted conductivity between cap 120 and bearing 106. Cap 120 may include, for example, four extensions disposed substantially evenly about annular member 130.

As can be seen, a first electrical path from the power supply to the photoconductive drum 102 is established. This first electrical path includes flow of the electric charge from the power supply to the cap 120, from the cap 120 to the bearing 106, and from the bearing 106 to the photoconductive drum shaft 116. Further, as the photoconductive drum shaft 116 is electrically connected with the photoconductive drum 102 via the photoconductive drum contact 119, the photoconductive drum 102 accordingly may be charged from the power supply as desired. Photoconductor drum 102 may be charged to a substantially uniform potential.

For example, cap 120 may be made from conductive metallic as well as non-metallic materials. Cap 120 may be constructed from stainless steel or like metals. Additionally, the cap 120 may be made by using a deep drawn process.

Charging apparatus 100 may further include a resilient, electrically conductive member which provides for an additional electrical path from cap 120 to photoconductor drum shaft 116. According to an exemplary embodiment shown in FIGS. 2-6, the conductive member may be a wire 122 that is electrically coupled with the bearing 106 and the cap 120. Wire 122 may include a leading end 124, a trailing end 126, and a middle portion 128, as shown in FIGS. 4 and 5. The wire 122 is dimensioned so as to be at least partly deformable to take a shape that is compatible with components of charging apparatus 100 to which wire 122 is physically engaged.

As seen from FIGS. 2 and 4-5, each of leading and the trailing ends 124, 126 of the wire 122 may be substantially linear and disposed on the first and the second tubular members 142, 144 of bearing 106, respectively. The leading end 124 of the wire 122 may extend through slot 158 of bearing 106 and be positioned substantially within first longitudinal groove 154 along the outer surface of first tubular member 142. Wire 122 physically contacts the inner surface 130 of the cap 120. In this regard, a portion of the leading end 124 of the wire 122 may protrude outwardly from groove 154 in order to better contact the inner surface of the cap 120, as shown in FIG. 2. With wire 122 being constructed from a conductive material, such as metal, such physical contact with cap 120 provides an electrical connection therewith.

The trailing end 126 of the wire 122 is disposed on the second side 110 of the bearing 106 along the outer surface of second tubular member 144. A portion of trailing end 126 is disposed substantially within groove 156 of second tubular member 144. As shown in FIGS. 2, 3 and 5, another portion 132 of trailing end 126 is angled relative to the remaining portion of trailing end 126 so as to extend over the distal end of second tubular member 144. In this way, as the photoconductive drum shaft 116 is received within the elongated passage of bearing 106, the portion 132 of trailing end 126 of the wire 122 physically contacts photoconductive drum shaft 116. With wire 122 being constructed from a conductive material, such as metal, such physical contact with photoconductive drum shaft 116 provides an electrical connection therewith.

Furthermore, as shown in FIG. 6, the middle portion 128 of wire 122 may be substantially circular so as to wrap around the second tubular member 144 where second tubular member 144 extends from the major (planar) portion of bearing 106.

As wire 122 forms an electrical connection with cap 120 and photoconductive drum shaft 116, a second (or dual) electrical path for the flow of electric charge is thereby created between the power source and the photoconductive drum shaft 116. This second electrical path allows current flow from the power source to the cap 120, from the cap 120 to the wire 122, and from the wire 122 to the photoconductive drum shaft 116. Further, as the photoconductive drum shaft 116 is electrically connected with the photoconductive drum 102 via the photoconductive drum contact 119, the photoconductive drum 102 is capable of being charged to a substantially uniform amount.

FIGS. 3 and 7 show charging apparatus 100 positioned within the image forming device 104. The apparatus 100 is disposed on the non-drive side of the image forming device 104 and electrically coupled with the one end of the photoconductive drum shaft 116. The image forming device 104 has a side wall 160 having a groove 162, such as a substantially V-shaped groove, to support the apparatus 100. The photoconductive drum shaft 116 is received within charging apparatus 100. Also disposed on the side wall 160 and near the groove 162 is the power supply contact 164 that physically contacts with the outer surface of the cap 120 and is thereby electrically connected thereto. The power supply contact 164 is coupled to a power supply (not shown). Power supply contact 164 thus provides for a substantially continuous charge flow to cap 120. Further, as shown in FIG. 7, cap 120 may have a cut portion 166 provided on the outer surface 136 in order to receive a portion of the power supply contact 164 therein. This ensures substantially continuous physical contact between power supply contact 64 and cap 120 which ensures a substantially continuous flow a charge.

Figure 8A:
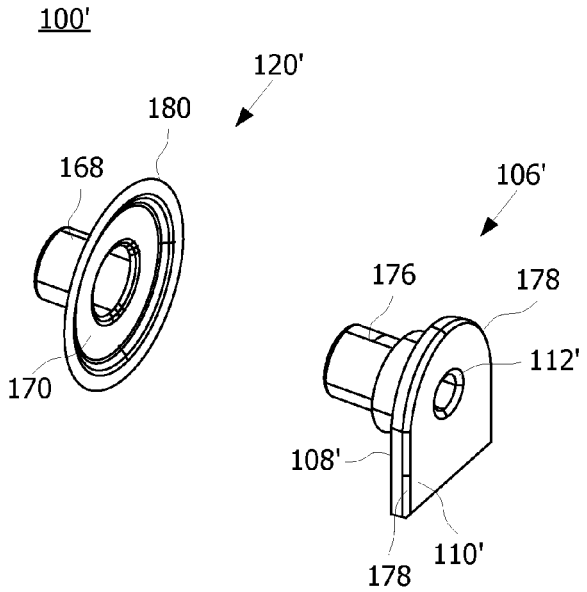
FIG. 8*a* shows an exploded perspective view of an exemplary embodiment of a charging apparatus according to the present invention.
Figure 8B:
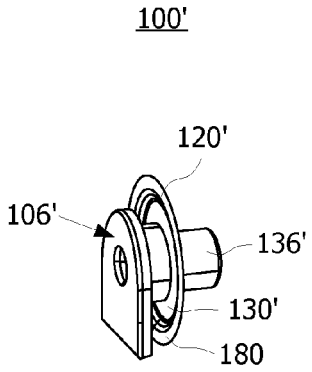
FIG. 8*b* shows an assembled view of the apparatus of FIG. 8*a*.
Figure 8C:
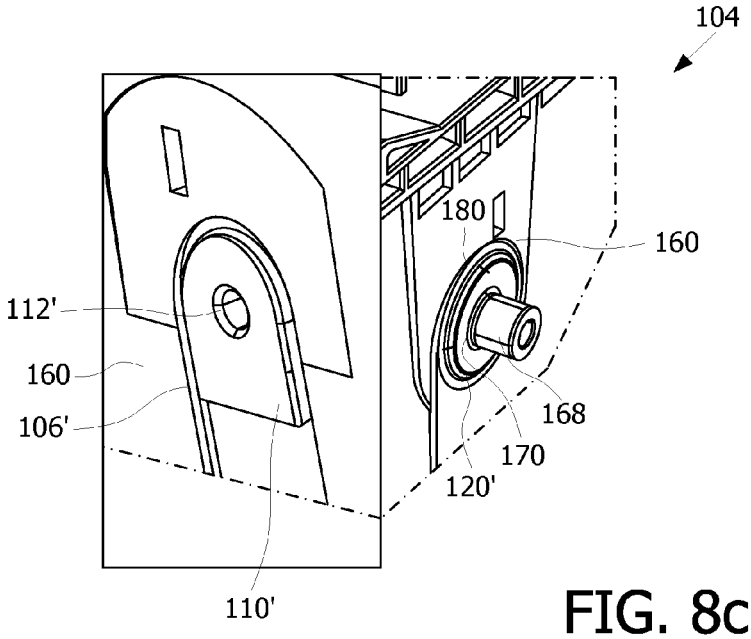
FIG. 8*c* illustrates a perspective view of the charging apparatus of FIGS. 8*a* and 8*b* connected within an image forming device.

FIGS. 8*a* through 8*c* show another exemplary embodiment of the present invention. Charging apparatus 100' provides electrical charge from the power supply (not shown) to the photoconductive drum (not shown). The apparatus 100' includes a cap 120' that has a first tubular portion 168 and annular portion 170 disposed at one end thereof. Annular portion 170 may extend radially outwardly to outer edge 180 from an end region of first tubular portion 168.

Charging apparatus 100' further includes a bearing 106' having an elongated portion 176 which is sized to be received within first tubular portion 168 of cap 120' to establish an electrical connection therewith. Bearing 106' includes first side 108', second side 110' and outer edge 178.

As shown in FIG. 8*b*, the elongated portion 176 of bearing 106' is received within the annular portion 170 of the cap 120' to form a single unit assembly therewith. This single unit assembly may be disposed on the side wall 160 of the image forming device 104, as shown in FIG. 8*c*. The cap 120', as noted above, may be disposed on the non-conductive layer formed on an outer surface of the bearing 106'.

A wire (not shown) of the size and shape as that of the wire 122 described previously, may be electrically connected to the bearing 106' and the photoconductive drum shaft, thereby forming an electrical path therebetween. The leading end of the wire may be disposed on the elongated portion 176 of the bearing 106' and is in electrical contact with the tubular portion 168 of the bearing 106'. The trailing end of the wire is disposed on the second side of the bearing 106'. Furthermore, at least a portion of the trailing end of the wire extends across the aperture of bearing 106'. As the one end of the photoconductive drum shaft is receive within the aperture of bearing 106', the at least a portion of the trailing end of the wire is substantially continuously in physical and electrical contact with the photoconductive drum shaft, thereby forming a second electrical path from cap 120' to the wire to the photoconductor drum shaft.

It is understood that charging apparatus 100, 100' may be utilized to charge other components within image forming device 104, such as a charge roll, developer roll and the like. In such uses, charging apparatus 100, 100' is coupled to and charges the shaft of the roll in a similar manner as described above with respect to charging apparatus 100, 100' charging shaft 116 of photoconductive drum 102.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An apparatus to provide an electrical charge to a photoconductive drum from a power supply within an image forming device comprising:

an electrically conductive member having a first side and a second side and an aperture having an opening to receive a shaft of the photoconductive drum;

an electrically conductive cap connected to the first side of the electrically conductive member, aligned with the aperture and electrically coupled with the shaft via the electrically conductive member; and an electrically conductive resilient member having a leading end and a trailing end, the leading end disposed on the first side of the electrically conductive member and electrically coupled with an inner surface of the electrically conductive cap and the trailing end disposed on the second side of the electrically conductive member, at least a portion of the trailing end extending across the aperture of the electrically conductive member, a first electrical path being defined between the electrically conductive cap, the electrically conductive member and the shaft and a second electrical path being defined between the electrically conductive cap, the electrically conductive resilient member and the shaft.

2. The apparatus according to claim 1, wherein the electrically conductive member further comprises:

a first tubular member extending from the first side of the electrically conductive member and having an opening aligned with the aperture of the electrically conductive member; and a second tubular member extending from the second side of the electrically conductive member and having an opening aligned with the aperture of the electrically conductive member and the opening in the first tubular member, the first tubular member, the second tubular member and the aperture forming a passage through which the shaft is received.

3. The apparatus according to claim 2, wherein the first tubular member includes a first longitudinal groove formed on an outside surface thereof and the second tubular member includes a second longitudinal groove formed on an outer surface thereof, each of the first and the second longitudinal grooves receiving respective portions of the electrically conductive resilient member therein.

4. The apparatus according to claim 3, wherein the at least a portion of the trailing end of the resilient member extends radially inwardly from the second longitudinal groove at least partially across the opening of the second tubular member for contacting the shaft.

5. The apparatus according to claim 3, wherein the electrically conductive cap is disposed over at least a portion of the first tubular member and at least a portion of the first longitudinal groove receiving at least a portion of the electrically conductive resilient member therein.

6. The apparatus according to claim 2, wherein a portion of the resilient member is wrapped at least partially circumferentially around an outer surface of the second tubular member, the portion of the resilient member forming an annular portion.

7. The apparatus according to claim 2, wherein the trailing end of the electrically conductive resilient member extends substantially diagonally across the opening of the second tubular member so as to contact the shaft when inserted therein.

8. The apparatus according to claim 2, wherein the electrically conductive cap is directly attached to the first tubular member.

9. The apparatus according to claim 1, wherein the electrically conductive cap includes a central aperture defined therein and at least one tab for establishing an electrical connection with the electrically conductive member, the at least one tab extending radially inwardly into the aperture so as to contact the electrically conductive member.

10. The apparatus according to claim 1, wherein the electrically conductive member includes an elongated portion extending from the first side of the electrically conductive member and having an opening aligned with the aperture of the electrically conductive member, the elongated portion sized to be received within and attached to the electrically conductive cap to establish the first electrical path.

11. The apparatus according to claim 10, wherein the electrically conductive cap includes a central aperture defined therein and at least one tab for establishing an electrical connection with the elongated portion of the electrically conductive member, the at least one tab extending radially inwardly into the aperture so as to contact the electrically conductive member, the elongated portion including an electrically conductive material coated with a non-conductive coating such that the at least one tab extends through the non-conductive coating and contacts the electrically conductive material when the electrically conductive cap is attached to the electrically conductive member.

12. An apparatus to provide an electrical connection between a component and a power supply within an image forming device, the apparatus comprising:

a rotatable shaft disposed within and coupled to the component such that rotation of the shaft rotates the component;

an electrically conductive shaft supporting member having a first side, a second side, and an aperture for receiving the shaft;

an electrically conductive cap disposed on and coupled to the first side of the electrically conductive shaft supporting member, the electrically conductive cap being aligned with the aperture and electrically coupled with the shaft via the electrically conductive shaft supporting member, the cap being coupled to the power supply; and an electrically conductive resilient member having a leading end and a trailing end, the leading end disposed on the first side of the electrically conductive shaft supporting member and electrically coupled with an inner surface of the electrically conductive cap and the trailing end disposed on the second side of the electrically conductive shaft supporting member and electrically coupled with a portion of the shaft, a first electrical path being formed between the rotatable shaft, the electrically conductive shaft supporting member and the electrically conductive cap and a second electrical path being formed between the electrically conductive cap, the electrically conductive resilient member and the rotatable shaft.

13. The apparatus according to claim 12, wherein the electrically conductive shaft supporting member further comprises:

a first tubular member extending from the first side of the electrically conductive shaft supporting member and having an opening aligned with the aperture of the electrically conductive shaft supporting member; and a second tubular member extending from the second side of the electrically conductive shaft supporting member and having an opening aligned with the aperture of the electrically conductive shaft supporting member and the opening in the first tubular member, the first tubular member, the second tubular member and the aperture forming a passage through which the shaft extends.

14. The apparatus according to claim 13, wherein the first tubular member includes a first longitudinal groove formed on an outside surface of the first tubular member and the second tubular member includes a second longitudinal groove formed on an outer surface of the second tubular member, each of the first and the second longitudinal grooves receiving a portion of the electrically conductive resilient member therein.

15. The apparatus according to claim 14, wherein a portion of the trailing end of the resilient member extends at least partly diagonally from the second longitudinal groove at least partially across the opening of the second tubular member so as to physically contact the shaft.

16. The apparatus according to claim 14, wherein the electrically conductive cap is disposed over at least a portion of the first tubular member and at least a portion of the first longitudinal groove having at least a portion of the electrically conductive resilient member disposed therein.

17. The apparatus according to claim 13, wherein the second tubular member has a portion of the resilient member wrapped at least partially therearound.

18. The apparatus according to claim 13, wherein the electrically conductive cap includes a central aperture defined therein and at least one tab for establishing an electrical connection with the first tubular member of the electrically conductive shaft supporting member, the at least one tab extending radially inwardly into the aperture so as to contact the electrically conductive shaft supporting member, the first tubular member including an electrically conductive material coated with a non-conductive coating such that the at least one tab extends through the non-conductive coating and contacts the electrically conductive material when the electrically conductive cap is attached to the electrically conductive shaft supporting member.

19. The apparatus according to claim 12, wherein the electrically conductive cap includes at least two extensions disposed on the inner surface of the electrically conductive cap thereof, the extensions piercing an outer surface of the electrically conductive shaft supporting member.

20. The apparatus according to claim 12, wherein the electrically conductive shaft supporting member is formed of an electrically conductive, plastic material.

21. The apparatus according to claim 12, wherein the component comprises a photoconductive drum.

22. The apparatus of claim 12, wherein the component comprises a roll in the image forming device.

23. The apparatus of claim 22, wherein the electrically conductive cap further comprises an outer surface, the outer surface being coupled to the power supply.

24. An apparatus for providing an electrical charge to a photoconductive drum within an image forming device comprising:

an electrically conductive cap having an inner surface;

an electrically conductive member having a first side, a second side, and an aperture to receive a shaft of the photoconductive drum, the first side including at least an elongated portion supported within the electrically conductive cap to which the electrically conductive cap is physically attached; and an electrically conductive resilient member having a leading end and a trailing end, the leading end disposed on the elongated portion of the electrically conductive member and electrically coupled with the inner surface of the electrically conductive cap and the trailing end disposed on the second side of the electrically conductive member, at least a portion of the trailing end extending across the aperture of the electrically conductive member for contacting the shaft.

25. The apparatus of claim 24, wherein the electrically conductive cap is directly attached to the elongated portion of the electrically conductive member.

26. The apparatus of claim 24, wherein the electrically conductive cap includes a central aperture defined therein and at least one tab for establishing an electrical connection with the elongated portion of the electrically conductive member, the at least one tab extending radially inwardly into the aperture so as to contact the electrically elongated portion, the elongated portion including an electrically conductive material coated with a non-conductive coating such that the at least one tab extends through the non-conductive coating and contacts the electrically conductive material when the electrically conductive cap is attached to the electrically conductive member.

* * * * *